United States Patent [19]

Esch et al.

[11] Patent Number: 4,696,146

[45] Date of Patent: Sep. 29, 1987

[54] PACKAGING MACHINES

[75] Inventors: Friedrich D. Esch, Andover; John G. Price, Bishop's Waltham, both of United Kingdom

[73] Assignee: AMF Incorporated, Minneapolis, Minn.

[21] Appl. No.: 849,502

[22] PCT Filed: Jul. 11, 1985

[86] PCT No.: PCT/GB85/00308

§ 371 Date: Mar. 6, 1986

§ 102(e) Date: Mar. 6, 1986

[87] PCT Pub. No.: WO86/00596

PCT Pub. Date: Jan. 30, 1986

[30] Foreign Application Priority Data

| | | | |
|---|---|---|---|
| Jul. 12, 1984 | [GB] | United Kingdom | 8417813 |
| Aug. 2, 1984 | [GB] | United Kingdom | 8419705 |
| Nov. 15, 1984 | [GB] | United Kingdom | 8428908 |
| Nov. 15, 1984 | [GB] | United Kingdom | 8428909 |

[51] Int. Cl.[4] ..... B65B 43/28; B65B 63/02; B65B 43/12

[52] U.S. Cl. ..... 53/529; 53/202; 53/570

[58] Field of Search ..... 53/202, 571, 573, 529, 53/530, 570

[56] References Cited

U.S. PATENT DOCUMENTS

| | | | |
|---|---|---|---|
| 2,671,588 | 3/1954 | Vogt | 53/202 X |
| 2,754,644 | 7/1956 | Vergobbi et al. | 53/570 X |
| 3,476,037 | 11/1969 | Gorby | 53/529 X |
| 3,481,268 | 12/1969 | Price et al. | 53/530 X |
| 3,903,674 | 9/1975 | Brush et al. . | |
| 4,353,198 | 10/1982 | Koppe | 53/570 |
| 4,387,550 | 6/1983 | Lerner | 53/570 X |
| 4,448,008 | 5/1984 | Pankratz et al. | 53/202 |
| 4,608,803 | 9/1986 | Araki | 53/202 |

FOREIGN PATENT DOCUMENTS 2558886 7/1977 Fed. Rep. of Germany .

*Primary Examiner*—Horace M. Culver

*Attorney, Agent, or Firm*—Willian Brinks Olds Hofer Gilson & Lione

[57] ABSTRACT

A packaging machine comprising:

(a) an intermittently rotatable pouch filling turret (1) having a plurality of pouch receiving stations;

(b) a pouch supplier (4);

(c) a pouch transfer unit (5) for taking empty pouches in sequence or in pairs from said pouch supplier and delivering the pouches in pairs to a first receiving position to the filling turret;

(d) means (2,3) for supplying material to be packaged in measured portions to said turret at a second receiving position of said turret;

(e) means (33) for discharging the measure portions from the turret into said pouches in pairs, and (f) a pouch take-off device (6) for taking off the pairs of filled pouches at a delivery position of said turret.

13 Claims, 9 Drawing Figures

PACKAGING MACHINES

The present invention relates to a packaging machine and more particularly, but not solely, to a machine for packing and handling tobacco pouches.

In known tobacco pouch packaging machines speeds of about 60 packages per minute are achieved. Speeds above this become problematical especially in view of the difficulty of transferring the pouches between operational stations where forces due to inertia or friction become significant.

It is an object of the invention to substantially increase the packaging speed to say in excess of 120 packages per minute.

According to the present invention there is provided a packaging machine comprising (a) an intermittently rotatable pouch filling turret having a plurality of pouch receiving stations, (b) a pouch supplier, (c) a pouch transfer unit for taking empty pouches in sequence from said pouch supplier and delivering the pouches in pairs to a first receiving position of the filling turret, said pouch transfer unit (i) including a central hub, (ii) an even number of arms pivoted on said hub on a pitch circle concentric with the rotary axis of the hub, (iii) a set of clamping plates at the distal ends of each of the arms, and (iv) means for causing an oscillatory movement of said arms during rotation of the hub and relative change in angular acceleration and deceleration between pairs of said arms whereby the clamping plates receive the pouches in sequence at a pouch receiving position and deliver adjacent pairs of pouches to said first receiving position of the filling turret, (d) means for supplying material to be packaged in measured portions to said turret at a second receiving position of said turret, (e) means for discharging the measured portions from the turret into said pouches in pairs, and (f) a pouch take-off device for taking off the pairs of filled pouches at a delivery position of said turret.

In a further form of the present invention a pouch take-off mechanism may be provided for transferring the pouches from the delivery position of the turret to another in an orientation of 180 degrees but not in the same plane as the take-off position, the mechanism comprising a rotatably mounted shaft supporting the arm on a disc, a cam plate rotatable in fixed relationship to said disc, a lever on said rotary shaft, and a cam follower on said lever engaged with a first cam surface of said cam plate.

By effecting a doubling of the empty pouch transfer unit, particularly from a pouch supplier which supplies pouches sequentially, and the simultaneous filling of pairs of pouches the overall handling speed is doubled in comparison with known packaging machines. An embodiment of the present invention will now be described, by way of example, with reference to the accompanying drawings, wherein.

Figure 1:
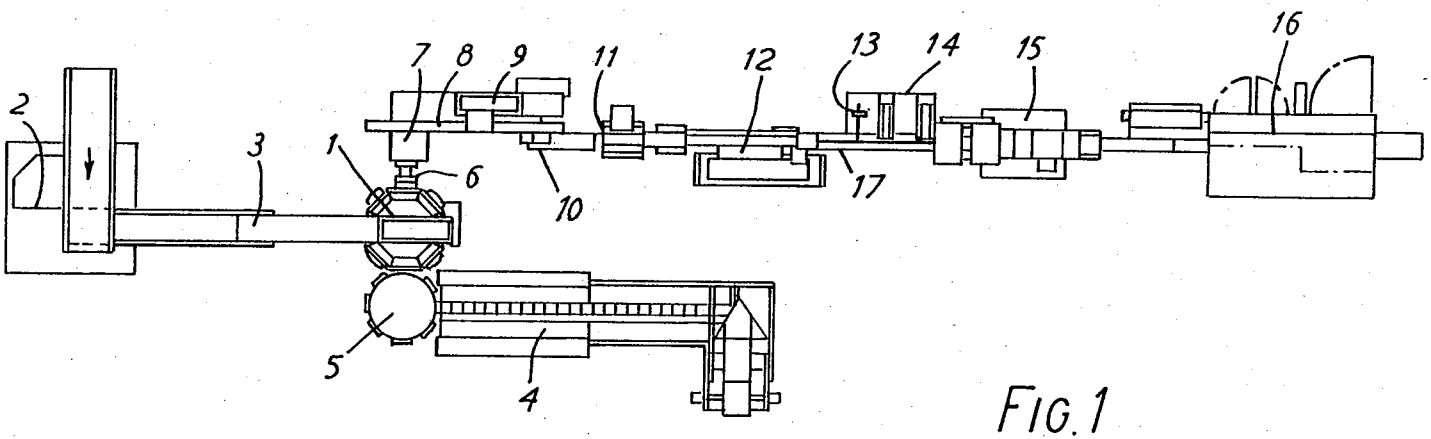
FIG. 1 shows a schematic view of a packaging 10 machine.
Figure 2:
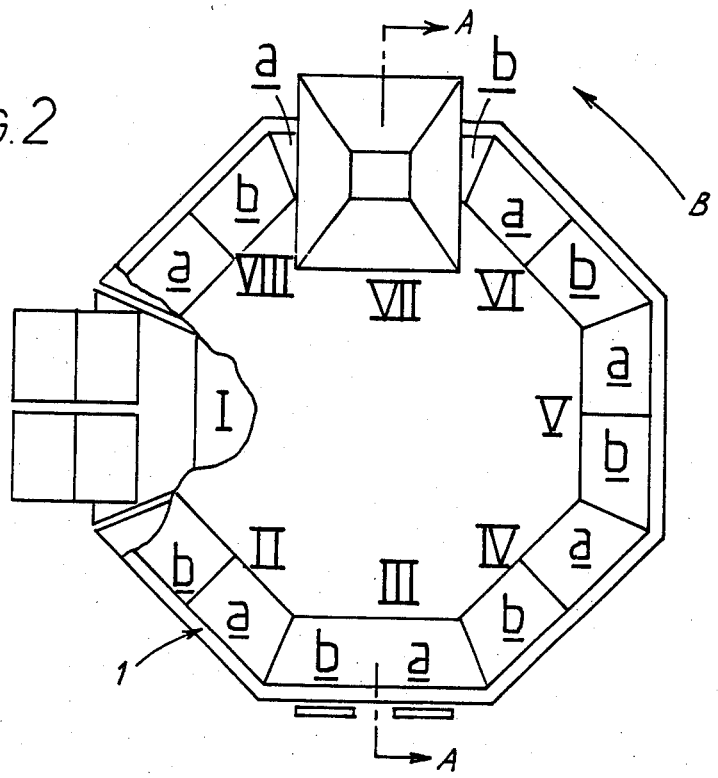
FIG. 2 shows a plan view of a turret.
Figure 3:
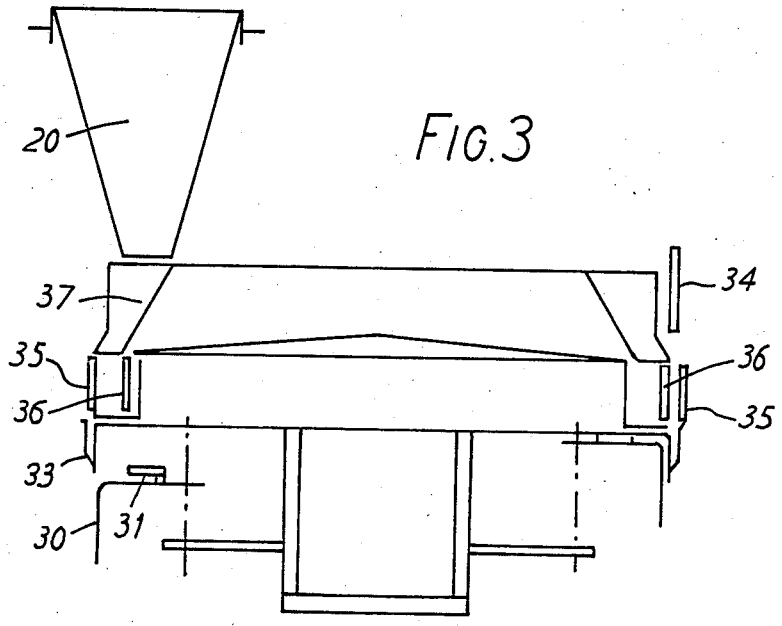
FIG. 3 shows a section along the line A—A of FIG. 2.
Figure 5:
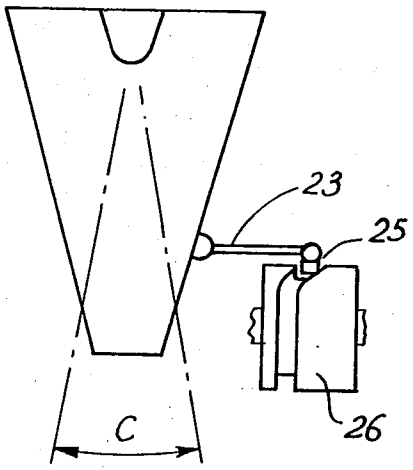
FIG. 5 shows a front view of the selector chute shown in FIG. 4.
Figure 4:
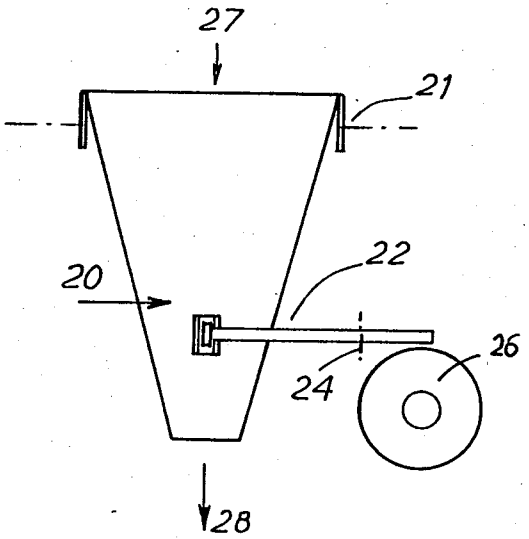
FIG. 4 shows a side elevation of a selector 15 chute.

The tobacco packaging machine shown in plan in FIG. 1 is formed by a line of processing stations, which line comprises a pouch packer turret assembly 1 to which is supplied portions of weighed tobacco from a 25 g hand rolled tobacco (HRT) weigher 2 via a bucket convèyor 3 and empty pouches from a pouch maker 4 via a pouch transfer unit 5. After filling the pouches are taken from the turret assembly 1 by a take-off device 6 and transferred to a pouch folder 7. The folded pouches leaving the folder are deposited on a conveyor 8 which conveys the pouches to a labelling unit 9. The remainder of the packaging line includes a take-off conveyor 10, a check weigher 11, a buffer store 12, a doffer 13, a pouch replacement device 14, an over-wrapper 15 and a boxing unit 16.

Tobacco portions are weighed by the weigher 2 and fed to the turret 1 by means of the bucket conveyor 3. The pre-weighed portions of tobacco are diverted by means of a selector chute into hoppers attached to the top of the turret which indexes through a distance equivalent to two hoppers, the tobacco portions being fed into the selector chute from the bucket conveyor 3.

With reference to FIGS. 2 to 5 there is shown a selector chute 20 arranged above turret 1 which has pairs of stations a and b and is rotatable in the direction of arrow B into eight positions I, II, III, IV, V, VI, VII and VIII. At position I two pouches are transferred to the turret and clamped onto the turret. As the turret moves from position II to position III tobacco is compacted in filling chutes and both pouches are lifted up so that filling chutes enter pouches and at position III tobacco is pushed into the pouches. As the turret moves from position III to position IV the pouches are removed from the filling chutes and compaction rams in the filling chutes open. At position V the pouch clamps are released and the pouches are removed from the turret.

The selector chute 20 is provided with lugs 21 which are pivotably mounted. Pivotably mounted on chute 20 is a link arm 22 which carries, at its end remote from the chute 20, a link arm 23. The link arm is pivotably mounted between its ends at 24. The link arm 23 carries, at its end remote from link arm 22, a cam follower 25 which runs in a groove of a cam 26. The groove is cut and the cam 26 operated so as to move the chute 20 synchronously with the turret at a given rotational speed. This enables the tobacco which enters the chute at 27 to be ejected from the chute at 28.

When the turret is stationary the selector chute 20 is arranged to enable a portion of tobacco to be dropped into a hopper at station b at position VII. On rotation of the turret to its next indexing position the hopper at station b of position VII moves to station b at position VIII. During the first half of this movement the chute 20 swings about arc C and deposits a tobacco portion into station b during motion. During the second half of the indexing movement the selector chute is stationary while the hopper at station a at position VI moves to station a at position VII. A portion of tobacco is then deposited by chute 20 in the hopper at station a at position VII before the chute 20 swings back about arc C to be arranged to enable a portion of tobacco to be dropped into a hopper at station b at position VII and to commence the cycle again.

This sequence maximises the time available in which to deposit tobacco portions in the hoppers.

During a one-second chute cycle divided into 24 increments, the chute is stationary and fills a hopper at station b from increments 0 to 5, indexing takes place and the chute moves with the turret from increments 5 to 9, there is a dwell from increments 9 to 13, the chute is stationary and fills a hopper at station a during increments 13 to 22, and the chute swings back from station a to station b during increments 22 to 24.

Figure 6:
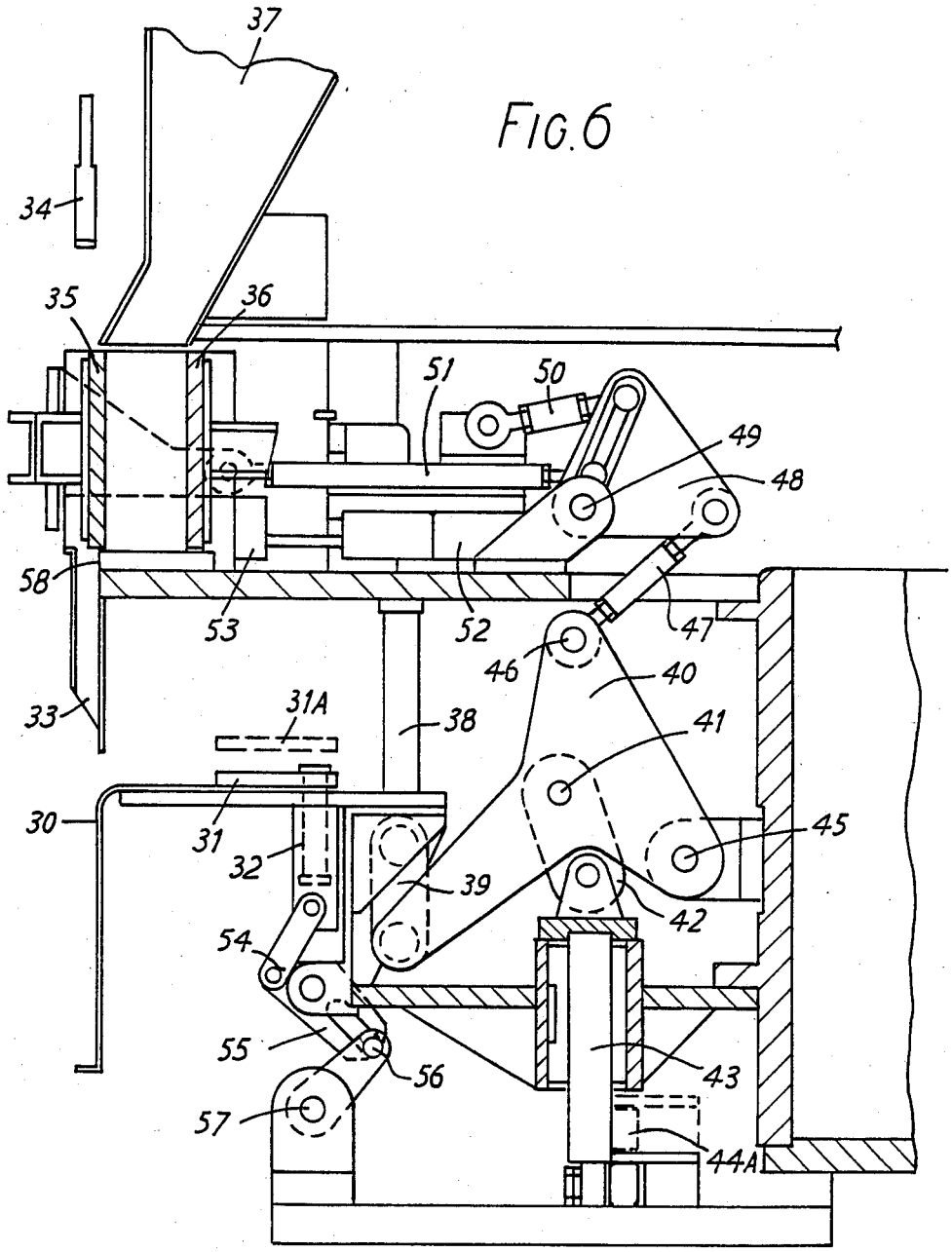
FIG. 6 shows a section through one of eight faces of a turret.

The arrangement for attaching tobacco pouches to the turret 1, pre-compacting tobacco and inserting tobacco into pouches will now be described with reference to FIG. 6. In order to achieve a greater rate of filling pouches, an eight sided turret is used, each side having a mechanism to fill two pouches.

Each face of the turret includes a pouch support platform 30 and a clamp 31 having a jaw urged towards the platform 30 by a compression spring 32. Above the platform 30 there is arranged a tobacco chute 33 beneath a ram 34. Above the chute 33 there are also arranged compacting jaws 35 and 36 beneath hoppers 37. In the open position of the jaws 35, 36 as shown in FIG. 6 the jaws define together with a base plate 58 on the turret a compression compartment for receiving and retaining the tobacco portion during compression.

The platform 30 is slidably mounted on a rod 38 and has a link arm 39 pivotably connected thereto. The end of the link arm 39 remote from the table is pivotably connected to one corner of a three-cornered pivot lift plate 40 pivoted about pivot 45. One end of a link arm 42 is connected to the pivot 41 and the other end of the link arm 42 is pivotably connected to a lug on a guide rod 43 having a cam follower 44.

A second corner of the plate 40 is pivotably mounted on a pivot 45 and to the third corner there is pivotably connected, at pivot 46, a tie rod 47. The end of the tie rod 47 remote from the plate 40 is pivotably connected to a triangular plate 48 which is pivoted on a pivot 49 and to which there are pivotably connected tie rods 50 and 51 which are connected to slideways 52 and 53 attached to the jaws 35 and 36.

Beneath the clamp 31 there is provided a Geneva link 54 and 55 connected to a rod 56 rotatable about a pin 57.

During an index from one position to another cam follower 44 is lifted to position 44A shown in chain-dotted lines. The rod 56 moves the Geneva link 54, 55 to urge the clamp 31 to its open position 31A shown in chain-dotted lines. When a pouch has been inserted between the clamp jaw and the pouch support platform 30 the reverse process occurs to allow the spring to urge the clamp 31 towards the platform 30 and clamp the pouch between platform 30 and the clamp jaw.

As cam follower 44 is lifted to its position 44A the lift plate 40 is raised and pivoted. By means of the interconnecting parts described the compacting jaws 35 and 36 will compress a tobacco portion therebetween and move the compressed portion to a position above the chute 33 clear of the base plate 58 until pivot 46 is vertically above pivot 45. At the same time the platform 30 slides vertically up rod 38 so that the chute 33 enters a pouch. Overtravel of the pivot 46 beyond top dead centre results in the jaws 35 and 36 opening slightly to reduce adhesion and/or friction between tobacco and jaws as the ram 34 pushes the tobacco into the pouch.

The arrangement therefore allows clamping a tobacco pouch on a platform which moves in a vertical direction, pre-compacting tobacco before insertion into a pouch and/or pre-compacting but with the compacting jaws opening slightly prior to the tobacco being transferred in order to minimize adhesion between jaws and tobacco.

The turret is described and claimed in a pending patent application Ser. No. 860,188.

Figure 7:
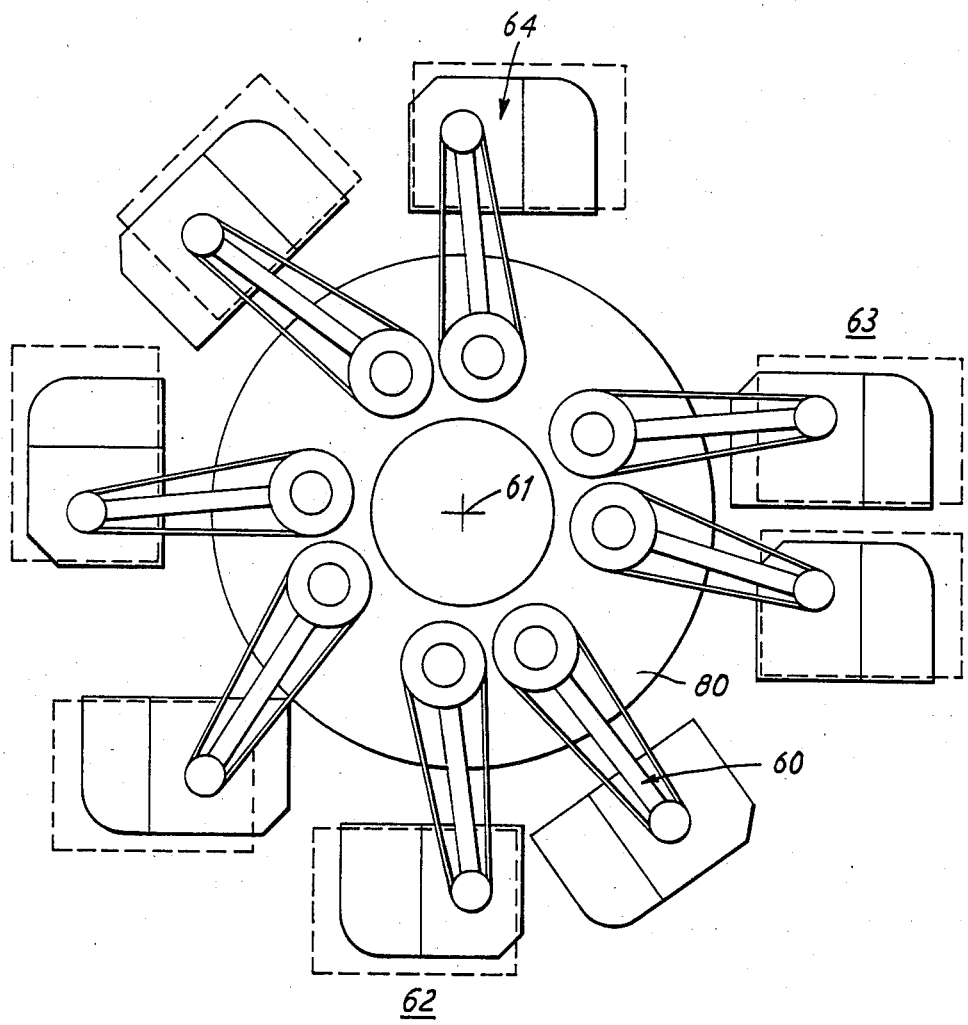
FIG. 7 shows a plan view of a rotary transfer mechanism.
Figure 8:
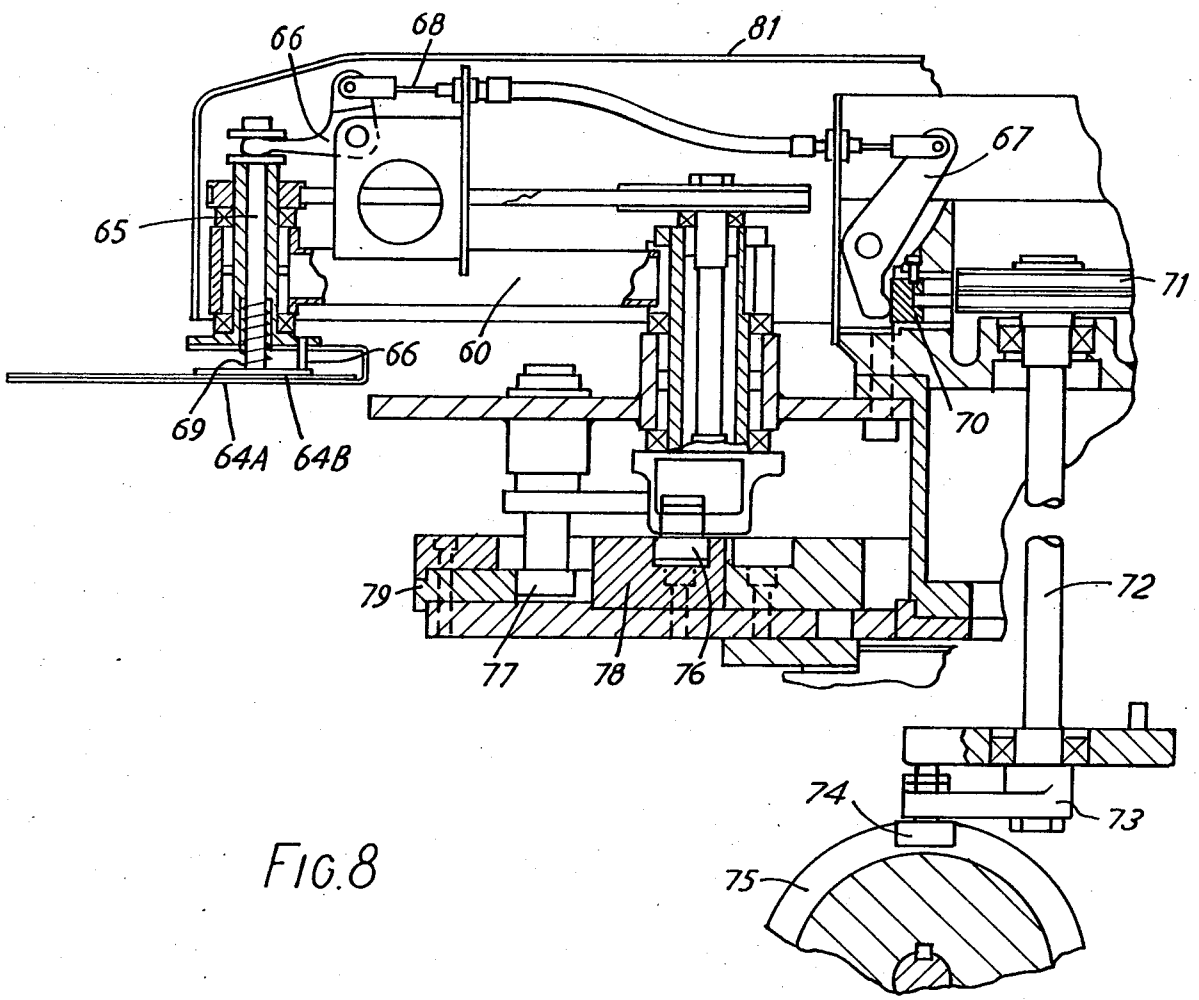
FIG. 8 shows a cross-sectional elevation of a part of the transfer mechanism shown in FIG. 7.

In FIGS. 7 and 8 there is shown a rotary transfer mechanism for transferring substantially flat or planar objects, particularly tobacco pouches from one machine to another machine and, in particular from a pouch making machine to a pouch filling machine such as turret 1. The transfer mechanism is particularly suitable for transferring tobacco pouches made from polyethylene, polythene, plastics composite material. However the objects may be flexible or rigid.

The transfer mechanism shown comprises eight support arms 60 movable around a central axis 61 from a pouch pick-up position 62 to a pouch discharge position 63. The support arms 60 are attached to a dial plate 80 which is bolted to the top of an indexing unit. Each arm 60 carries a pair of clamping plates 64. Each pair of plates comprises a fixed lower plate 64A and a vertically movable upper plate 64B. Both plates are corrugated along their length so that they fit together and impart a corrugation to pouch material therebetween. This effectively stiffens pouch material projecting beyond the plates.

The upper plate 64B is mounted on a vertical shaft 65 and a guide pin 66 is provided to ensure that the plates 64A and 64B rotate together. The end of the shaft 65 remote from the plate 64B is connected to a lifting arm 66 which is connected to cam-operated lever 67 by a flexible cable 68. The plate 64B is normally urged into engagement with the plate 64A by a spring 69. The lever 67 is pivotably mounted between its ends and its end remote from the cable 68 abuts a cam follower 70 which follows one of a pair of cams 71 which causes movement of plate 64B away from plate 64A against the action of spring 69 and allows the spring 69 to return plate 64B into clamping engagement with plate 64A.

The cams 71 are mounted on a cam-shaft 72 which has an arm 73 at its other end. The arm 73 carries a cam follower 74 following a cylinder cam 75 to oscillate the cam-shaft 72 as required. The speed of rotation of the cylinder cam 75 is synchronised with the indexing system for the clamping plates.

The orientation of the clamping plates and support arms are controlled by the relative position of cam followers 76 and 77 in cams 78 and 79, respectively.

The cams 71, 75, 78 and 79 are shaped and arranged so that normally each pair of clamping plates arrives at the pick-up position 62 singly in one orientation and two pairs of clamping plates arrive at the discharge position 63 in tandem in a second orientation. Each one of the tandems is controlled by one set of cams 78, 79 and one of the pair of cams 71 in one mode and each other of the tandems is controlled by another set of cams 78, 79 and other of the pair of cams 71 in another mode. The moving parts are encased in a cover 81.

The pouches issue from the maker 4 sequentially and arrive opposite the pouch pick-up position 62 in a substantially horizontally disposed attitude. Each pouch is delivered onto the fixed lower plate 64A of the clamping plate pair 64 with the open edge of the pouch extending substantially radially. During travel from the pull-up position 62 to the discharge position 63 the pouch is translated through an angle of about 90 degrees in relation to its support arm 60. The open edge of the pouch is therefore substantially tangential to the plate 80 the discharge position the portion of the flap of the pouch not gripped by the plates 64 comes between the platform 30 and clamp 31 of the turret 1.

At the discharge station the pouches are clamped on the filling machine, e.g. turret 1, before being released by the clamping plates 64. On movement of the turret 1, the pouch falls into vertical position with the portion clamped by the platform 30 and clamp 31 remaining horizontal. The tobacco receiving portion of the pouch is sufficiently open for entry of the chute 33 as the pouch is raised.

Figure 9:
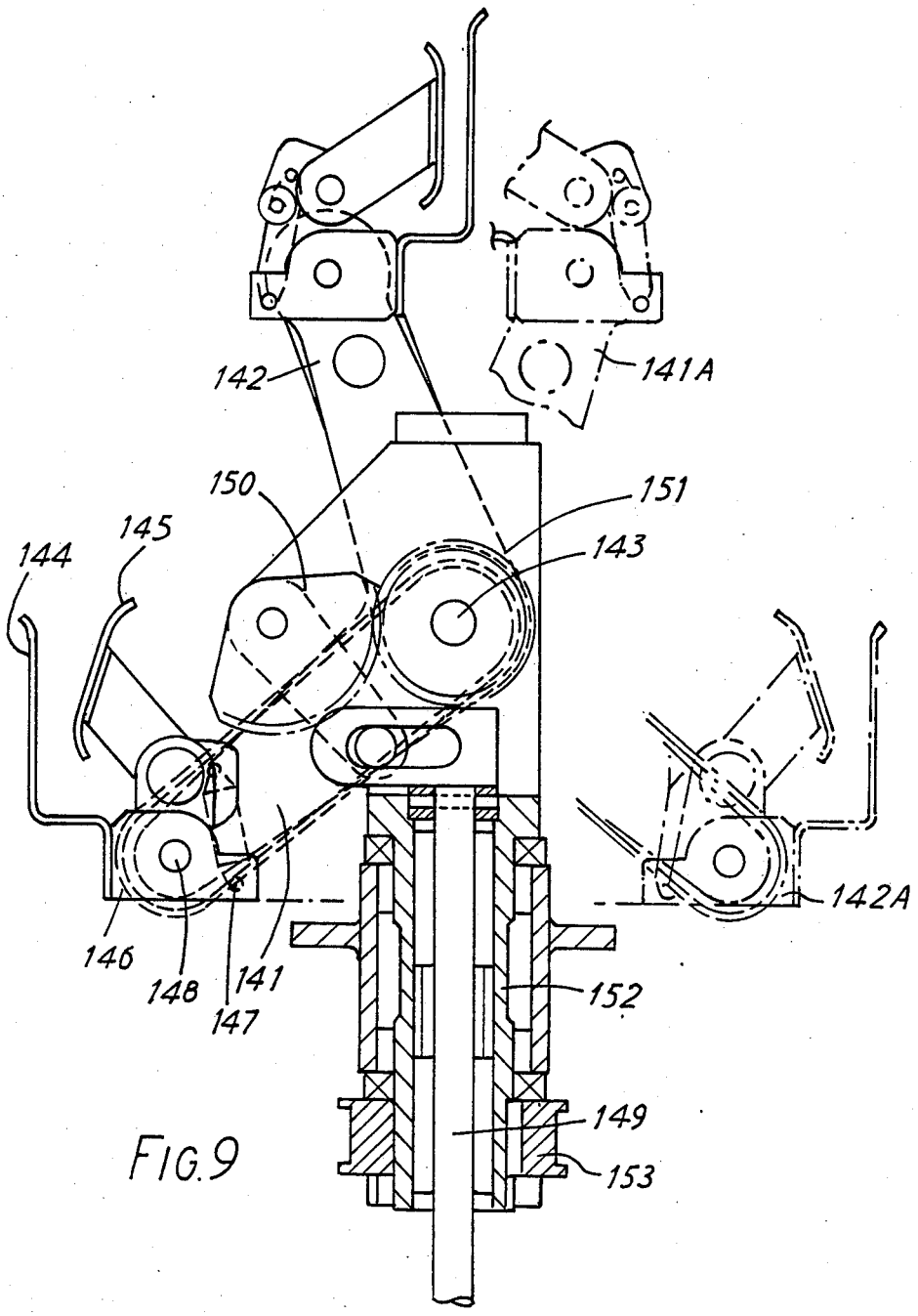
FIG. 9 is a cross-sectional elevation of a pouch transfer mechanism.

In FIG. 9 there is shown a transfer mechanism for transferring articles from one position to another position situated 180 degrees in the horizontal plane from the first position by rotating the articles about horizontal and vertical axes. The transfer mechanism is particularly suitable for filled tobacco pouches.

The mechanism comprises two arms 141 and 142 at a fixed relation to each other and which are pivotable about shaft 143. At the extremities of each arm are pouch clamps having a static clamp face 144 and a movable face 145 to clamp a pouch face 145 being operated by a cam 146 against the action located on a spindle 148 and a pulley which is connected via a timing belt to a fixed pulley on shaft 143 ensures that the clamping face 144 remains vertical during any motion. The arms 141 and 142 can swing up and down as a result of shaft 149 travelling vertically and activating pinions 150 and 151, the latter pinion being attached to shaft 143 which in turn is connected to arms 141 and 142.

The arm assembly is mounted in a housing 152 which can be rotated about a vertical axis by movement of a pulley 153.

In operation, upward movement of the arm 141 picks up and clamps a pouch between jaws 144 and 145. At the same time, the pouch already clamped between the jaws at the end of arm 142 is lowered and transferred to the pouch holder. After a rotation of the housing 152 through 180 degrees the arms 141 and 142 are now in positions 141A and 142A, respectively. The jaws at the end of arm 142 are now in a lower position ready to receive a pouch. By oscillating the whole assembly back through 180 degrees, the arm 141 returns to its start position, ready to pick up and transfer another pouch.

Filled pouches can be securely picked off one machine, rotated through 180 degrees and deposited in the pouch folder while keeping the pouches vertical.

The pouch folding machine (item 7 in FIG. 1) takes the filled pouches two at a time and effects a folding of the pouch flap.

The pouches leaving the folder 7 in pairs are deposited on the conveyor 8 and move to the labelling unit 9. The take-off conveyor 10 at the outlet of the labelling unit feeds the pouches in sequence past the check weigher 11 to the buffer store 12 from which the pouches are fed to a dog conveyor 17 to the overwrapping unit 15.

A pouch replacement unit (shown at 14 in FIG. 1) is provided so that filled tobacco pouches can be inserted between dogs of the dog conveyor 17 in the event of there being no pouch present between the dogs. A complete feed system may comprise one or two of the feeder units shown.

Pouches are stored in a magazine which is manually fed and sited alongside a dog conveyor which has dogs equally spaced so that the distance between dogs is greater than the length of the pouches.

When a photo-electric cell indicates that no pouch is present, a signal actuates a solenoid operated air valve which enables a pneumatic cylinder to push a pouch onto the dog conveyor.

A mechanical device known as a doffer (13 in FIG. 1), which relocates pouches, which do not fall between adjacent dogs of a dog conveyor, in their correct position on the conveyor.

The doffer is essentially a horizontal shaft with a number of radial rubber blades of equal length attached to it rotating at a speed so that the tangential velocity of the ends of the rubber blades are greatly in excess of the conveyor speed. This unit is located above the dog conveyor so that should a pouch lie on top of a dog, leaning forwards, it will be projected forwards by the doffer into the preceding space between the dogs. In the event of a pouch leaning backwards on a dog, a friction pad at the side of the conveyor will drag the pouch backwards before passing under the doffer.

We claim:

1. A packaging machine comprising (a) an intermittently rotatable pouch filling turret having a plurality of pouch receiving stations;

(b) a pouch supplier;

(c) a pouch transfer unit for taking empty pouches in sequence from said pouch supplier and delivering the pouches in pairs to a first receiving position of the filling turret, said pouch transfer unit (i) including a central hub, (ii) an even number of arms pivoted on said hub on a pitch circle concentric with the rotary axis of the hub, (iii) a set of clamping plates at the distal ends of each of the arms, and (iv) means for causing an oscillatory movement of said arms during rotation of the hub and relative change in angular acceleration and deceleration between pairs of said arms whereby the clamping plates receive the pouches in sequence at a pouch receiving position and deliver adjacent pairs of pouches to said first receiving position of the filling turret, (d) means for supplying material to be packaged in measured portions to said turret at a second receiving position of said turret, (e) means for discharging the measured portions from the turret into said pouches in pairs, and (f) a pouch take-off device for taking off the pairs of filled pouches at a delivery position of said turret.

2. A machine according to claim 1, wherein means are provided for moving the clamping plates between one orientation at the pouch receiving position and a second orientation at the first receiving position of the filling turret.

3. A machine according to claim 2, wherein said means for causing an oscillatory movement of each arm comprises a rotary shaft supporting the arm on a disc, a cam plate rotatable in fixed relationship to said disc, a lever on said rotary shaft, and a cam follower on said lever engaged with a first cam surface of said cam plate.

4. A machine according to claim 3, wherein said means for moving the clamping plates between different positions of orientation comprise a shaft passing through a bore in the rotary shaft, a second lever attached to said shaft, and a second cam follower on said shaft engaged with a second cam surface of said cam plate.

5. A machine according to claim 4, wherein said clamping plate comprise a first plate fixed to a second rotary shaft mounted at the distal end of the arm, and a second plate carried by said second rotary shaft and movable towards and away from said first plate to effect clamping and release respectively.

6. A machine according to claim 5, wherein the movable clamping plate is operated by cam means via a first bell-crank lever pivotally mounted on the central hub, a Bowden cable, and a second bell-crank lever which drives an axially movable shaft to which said movable clamping plate is mounted.

7. A machine according to claim 1, wherein the pouch take-off comprises a rotatably mounted housing for oscillation about a vertical axis, first and second arms pivotally mounted on said housing in fixed relationship to each other on a horizontal axis at right angles to the vertical axis, each arm having clamps for clamping a pair of pouches, means for rotating said housing and said arms whereby on rotation of said housing and arms about said axes, the pouches taken off the filling turret are maintained in a substantially vertical disposition whilst being rotated through 180 degrees.

8. A machine according to claim 1, wherein said means for supplying measured portions comprise a bucket conveyor providing a continuous single stream of measured portions.

9. A machine according to claim 8, wherein a movable chute is provided to fill adjacent chambers of a pair, means being provided for moving said chute in timed relationship to said turret whereby the discharge end of the chute remains over one of a pair of chambers during an indexing movement of the turret.

10. A machine according to claim 9, wherein the means for moving the chute is driven in such manner that the discharge end of the chute dwells over the other of the pair of chambers with the turret in an indexed position.

11. A machine according to claim 1, wherein each station having means for receiving and clamping a pair of pouches, a pair of chambers for receiving the measured portions of material, and means for compressing the portions of material within the chambers.

12. A machine according to claim 11, wherein means for discharging are provided at a material transfer position and comprise a pair of rams which can pass through the chambers at each station as each station arrives and is indexed at said material transfer position to insert the portions in the pouches.

13. A machine according to claim 1, wherein said means for supplying measured portions comprises conveyor means providing two continuous streams of measured portions, the conveyor means discharging two portions simultaneously into adjacent chambers at one station of the turret.

* * * * *